US009661417B2

(12) United States Patent
Grimes et al.

(10) Patent No.: US 9,661,417 B2
(45) Date of Patent: May 23, 2017

(54) SYSTEM, METHOD, AND COMPUTER PROGRAM PRODUCT FOR VOICE DECIBEL MONITORING ON ELECTRONIC COMPUTING DEVICES

(76) Inventors: Linda Grimes, Reno, NV (US); Patrick Grimes, Reno, NV (US)

( * ) Notice: Subject to any disclaimer, the term of this patent is extended or adjusted under 35 U.S.C. 154(b) by 529 days.

(21) Appl. No.: 13/568,950

(22) Filed: Aug. 7, 2012

(65) Prior Publication Data

US 2013/0039501 A1 Feb. 14, 2013

Related U.S. Application Data

(60) Provisional application No. 61/521,097, filed on Aug. 8, 2011.

(51) Int. Cl.
*H04R 29/00* (2006.01)
*H04R 3/00* (2006.01)

(52) U.S. Cl.
CPC ..... *H04R 3/007* (2013.01); *H04R 2499/11* (2013.01)

(58) Field of Classification Search
CPC ..... H04R 3/007; H04R 2499/11
USPC ..... 381/58, 56
See application file for complete search history.

(56) References Cited

U.S. PATENT DOCUMENTS

2003/0174830 A1* 9/2003 Boyer et al. ..... 379/265.02

* cited by examiner

*Primary Examiner* — Paul S Kim

(57) ABSTRACT

The present invention in general relates to a voice decibel application and a method for a phone and in particularly relates to the application and the method for a phone to measure the voice decibel during a phone call. The application incorporated into the user's phone is configured to measure the voice decibel during a phone call and send a signal to the user in case the voice decibel exceeds or goes below a preset voice decibel threshold level. The present invention is advantageous because it will help the users to recognize their talking habits and assist them in improving their talking habits.

20 Claims, 4 Drawing Sheets

SYSTEM, METHOD, AND COMPUTER PROGRAM PRODUCT FOR VOICE DECIBEL MONITORING ON ELECTRONIC COMPUTING DEVICES

CROSS REFERENCE TO RELATED APPLICATION

The present application claims priority benefit under 35 U.S.C. §119 (e) to U.S. Provisional Patent Application No. 61/521,697 filed Aug. 8, 2011 by Linda Grimes, entitled "Voice decibel application and a method for a cellular phone". The present application incorporates the foregoing disclosure herein by reference.

TECHNICAL FIELD OF INVENTION

Embodiments of the present invention generally relate to a voice decibel application and a method for a cellular phone and in particularly relates to the application and the method for a cellular phone to measure the voice decibel during a phone call. The said voice decibel application is incorporated into the user's electronic computing device (e.g. cellular phone), and is configured to measure the voice decibel during a phone call and alert the user by sending a signal in case the voice decibel exceeds or goes below a preset voice decibel threshold level.

BACKGROUND OF INVENTION

With the development of wireless communication and information processing technology, portable electronic devices such as mobile phones are now in widespread use. Consumers may now enjoy the full convenience of high technology products almost anytime and anywhere. Mobile communication devices are used in many different environments, due to their portable nature.

Sometimes individuals talking on mobile phones are either fully or partially unable to detect or perceive at least some frequencies of voice. The loudness of the voice heard is measured in decibel and may be ranked as mild (about 30 dB), moderate (about 60 dB), severe or profound (more than about 90 dB) depending upon the decibels. The individual may need to vary their voice decibel level depending on their respective time and location. For example, the person needs to vary his voice decibel level depending upon if they are at a construction site or at his office so as to make them audible.

Therefore in general the cellular phone user may need to adjust their voice decibel level while talking on the cellular phone such as mobile phone and it has therefore become a matter of increasing concern in the recent years. For example, any voice sound above 85 dB can cause hearing loss, and the loss is related both to the power of the sound as well as the length of exposure.

Therefore there is a need in the art to measure the voice decibel while talking on the phone and alert the user if the voice decibel exceeds or goes below a preset voice decibel threshold level.

SUMMARY OF THE INVENTION

The present invention in general relates to a voice decibel computer program product, such as a mobile application, and a method for its use on an electronic computing device (e.g. cellular phone or smartphone with Internet connectivity) to measure the user's voice decibel during a phone call. The voice decibel application is incorporated into the user's device, and is configured to measure the voice decibel during a phone call and alert the user by sending a signal in case the voice decibel exceeds or goes below a preset voice decibel threshold level. In an alternative embodiment, both parties on the phone call may monitor their voice decibels levels concurrently if their respective electronic computing device has the software application of this invention installed.

According to an embodiment of the present invention there is provided a voice decibel application and method that is incorporated into the user's phone wherein the application will actively measure the voice decibel during a phone call. The application and method is incorporated into the user phone by a plurality of means including but not limited to downloading from Internet, installation through crystal disc (CD) or direct hardwire to device. The application will send a signal if the user's voice increases to a level to a hearing level not comfortable to the listener (recipient) that is predefined by the application by considering and implementing several factors, comprising: the talking behavior of the User, environmental and surrounding conditions and noises. Furthermore, the application and method installed on the user phone will also notify the user through a plurality of means including but not limited to vibration, blinking light, beep sound etc., if the voice decibel increases or decreases to a level which is unpleasant or hard to understand by the recipient.

According to an embodiment of the present invention there is provided a voice decibel application and method that sends the signal to the user in case the voice decibel exceeds or goes below a preset voice decibel threshold level. The signaling means could be any mechanism to seek the speaker's attention, such as an alarm or a light or a vibration or a text message or a multi media message etc., but not limited to these alone.

The embodiment of the present invention is advantageous because it will help the users to recognize their talking habits and assist them in improving their talking habits such as couples in counseling, workers in negotiations or students in speech therapy. According to an embodiment of the present invention there is provided a voice decibel application and method that can be incorporated into a cell/mobile phone by one of the many ways known in the art including but not limited to software downloading from internet, or software download from computer, or by the software purchased individually. The device can also be incorporated by way of a direct hardware or modifications to existing hardware using any number of existing strategies well known to those in the art.

According to an embodiment of the present invention there is provided a voice decibel application and method that includes transmission of signals to alert or notify the user in case the voice decibel exceeds or goes below a preset voice decibel threshold level during a call. The signals generated from the phone can include any number of mechanisms such as the following immediate feedback from the phone such as the vibration, emission of sound or light to alert or notify the user. Furthermore, there could also be self-adjusting mechanisms provided in the cell/mobile phone that are configured to adjust the voice decibel to appropriate settings such as place or confidentiality to help Speaker (User) maintain desired volume, improve speaking skills and communicate better.

According to an embodiment of the present invention there is provided a voice decibel application and method that transmits the signal to alert or notify the user in case the voice decibel exceeds or goes below a preset voice decibel threshold level during a call. The signal generated could be in form of the automatic termination of the phone call or even a delay with a subsequent freeze on accepting the in and out going phone calls.

According to an embodiment of the present invention, said signal generated could be in form of an electronic message that is sent via text or electronic mail. The said electronic message can contain details that provide the frequency and time in which the established parameters of voice decibel were exceeded, and as well as the average decibel system value showing both the high and low value.

In another embodiment of the present invention, the said electronic message can be generated from the receiver's phone or the listening party and could be sent via a signal to the speaking party to alert or notify said speaking party if the voice decibel fell below or above the predefine threshold level during a prescribed call.

According to an embodiment of the present invention said signal can be prompted by any individual or combination of event(s) such as exceeding or below a targeted threshold based on the occurrence, frequency of occurrence, or any other combinations.

According to an embodiment of the present invention there is provided a voice decibel application and method that work effectively in a tandem network. Both the user and the recipient may receive feedback on their voice decibel levels if the software application of the present invention is installed on their respective device. In an alternative embodiment, the software application installed on the user's device may concurrently monitor both the user's and recipient's decibel levels.

According to an embodiment of the present invention there is provided a voice decibel application and method that prevents the amplification of background noise during periods of silence on the network call.

According to an embodiment of the present invention there is provided a voice decibel application and method that does not cause oscillation of the voice signal.

According to an embodiment of the present invention there is provided a voice decibel application and method for controlling a mobile device's ringer or vibration or speaker volume based on the surrounding environment's noise level.

According to an embodiment of the present invention there is provided a voice decibel application and method for preparing user friendly reports or text messages or emails or any other form of communication using mathematical calculations and algorithms providing the speaking patterns of User for any period of time and any suggestions for improvement.

In accordance with one or more embodiments, an application and method for measuring the voice decibel of a mobile device is provided. The application and method comprises a voice decibel value preset in the mobile device; recording and measuring voice decibel while the mobile phone user makes a call; signaling the user when the measured voice decibel goes below or above the preset voice decibel.

In an alternative embodiment of the invention, the software application may record, measure, analyze and report on the decibel levels of the voices of user's engaged in person-to-person conversations, such as couples therapy and anger management training. The software is installed on electronic computing devices that with the capabilities to record conversations.

These and other features, aspects, and advantages of the present invention will become better understood with reference to the following description. This summary is provided to produce a selection of concepts in a simplified form. This summary is not intended to identify key features or claimed features of the present invention, nor is it intended to be used to limit the scope of the claimed invention.

BRIEF DESCRIPTION OF DRAWINGS

The above and other features, aspects, and advantages of the present invention will become better understood with regard to the following description, appended claims, and accompanying drawings where:

Reference will now be made in detail to the present preferred embodiments of the present invention, examples of which are illustrated in the accompanying drawings. Wherever possible, the same reference numbers are used in the drawings and the description to refer to the same or the like parts.

DETAILED DESCRIPTION OF THE INVENTION

The present invention in general relates to a voice decibel application and a method for a phone and in particular relates to the application and the method for a phone to measure the voice decibel during a phone call. The said application is incorporated into the user's phone and is configured to measure the voice decibel during a phone call and send a signal to the user in case the voice decibel exceeds or goes below a preset voice decibel threshold level.

Glossary of Terms

As used herein, the term "Electronic Computing Device" refers to any electronic device comprising a central processing unit (i.e. processor) with the ability to perform decibel calculations, and may comprise devices with cellular phone capacity and/or with Voice over Internet Protocol (VoIP) phone capability via a web connectivity, such as: laptops, desktops, Android® tablets, iPads, and mobile electronic communications devices—e.g. smartphones, cell phones, and personal digital assistant devices.

As used herein, the term "Graphical User Interface" or "GUI" refers to the screen or display of the computing device wherein the content item is displayed, the text message or email comprising the report showing the user's decibel level.

As used herein, the term "Content" refers to any kind of digital information displayed on the screen of a computing device (e.g. smartphone), such as messages (IM, SMS, email, etc.).

As used herein, the terms "Module" and "Algorithm" and "Code" refer to a portion of a computer program or software that carries out a specific function and may be used alone or combined with other modules or algorithms of the same program.

As used herein, the term "Software" refers to computer program instructions adapted for execution by a hardware element, such as a processor, wherein the instruction comprise commands that when executed cause the processor to perform a corresponding set of commands. The software may be written or coded using a programming language, and stored using any type of non-transitory computer-readable media or machine-readable media well known in the art. Examples of software in the present invention comprise any software components, programs, applications, computer programs, application programs, system programs, machine programs, and operating system software.

As used herein, the term "System" may be used to claim all aspects of the present invention wherein it refers to the entire configuration of devices, hardware and software in all embodiments, such as an electronic computing devices with the present invention's computer program product installed.

Figure 1:
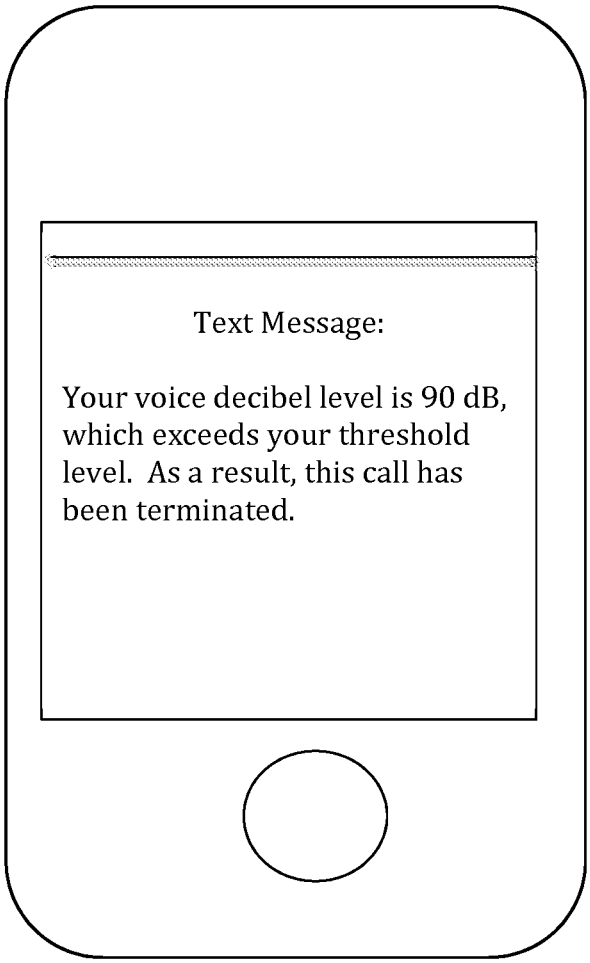
FIG. 1 is an illustration of exemplified messages and alarms received on a user's electronic computing device when the user's voice decibel level goes above or below the pre-set thresholds.

FIG. 1 illustrates an electronic computing device (e.g. a smartphone) with the computer program product installed. During a wireless telephone conversation, or a web Voice over Internet Protocol (VoIP) conversation (e.g. Skype® installed on a smartphone with 4G), the voice decibel of the user of the device is calculated by the software in the mobile phone according to one embodiment of the present invention. The application and method comprises a voice decibel value preset in the mobile device by the user. The voice decibel application incorporated into the mobile phone measures the voice decibel of the user speaking on the mobile phone and further determines when the measured voice decibel goes below or above the preset voice decibel threshold value. The application and method installed on the user phone will send a signal, for example, if the user's voice increases to a level of causing noise pollution or unpleasantness to the recipient. Further said application and method installed on the user phone will also send a signal to the user if the voice decibel decreases to a level which is unpleasant or hard to understand by the recipient. Signals comprise: generating a vibrating sensation or an audible alarm (e.g. voice, music, beeps, rings, etc.) emitted from the phone; termination of the call; email/SMS/chat message; and so forth.

In a preferred embodiment, the user engages in a three way conference call with the recipient, wherein the user's (and the recipient's) conversation is recorded on the alternate call line. The recording is then used by the software to analyze the user's decibel level and generate a report, which may be transmitted electronically to the user's device. This maybe particularly useful in the event the electronic computing device manufacturer has installed protective devices that limit the recording or monitoring of a call directly from their device. The third-party recording services are well known to those in the art.

Figure 2:
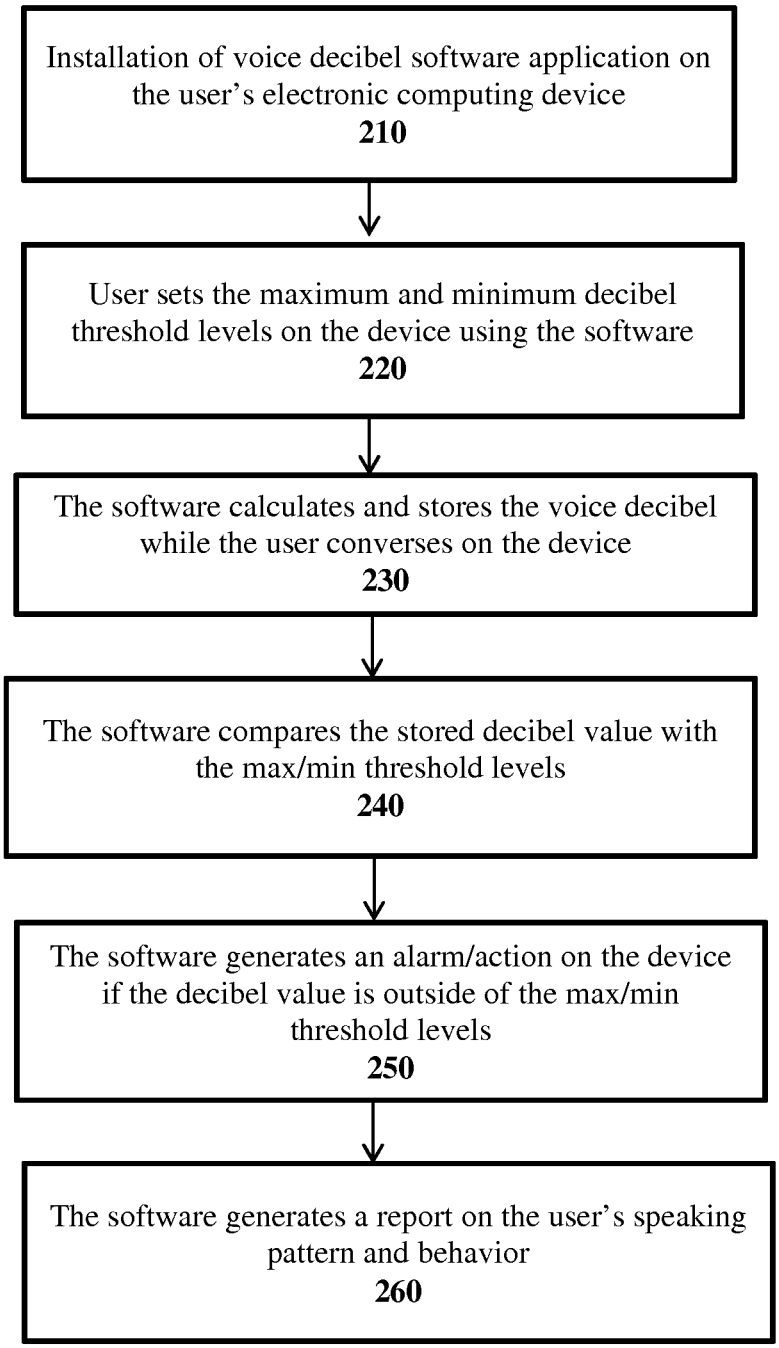
FIG. 2 is a flowchart of steps using the computer program product installed on an electronic communications device to measure the voice decibel of a user during an electronic voice conversation.

A flowchart of steps in the decibel monitoring of a phone conversation of the present invention is illustrated in FIG. 2, wherein the module or software comprises commands that when executed cause the electronic computing device's processor(s) to perform the following steps: (a) installation of voice decibel software application on the user's electronic computing device 210; (b) setting by the user of the maximum and minimum decibel threshold levels on the device using the software 220; (c) the software calculating and storing the voice decibel while the user converses on the device 230; (d) the software comparing the stored decibel value with the max/min threshold levels 240; (e) the software generating an alarm and/or action on the device if the decibel value is outside of the max/min threshold levels 250; and (f) the software generating a report on the user's speaking pattern and behavior 260.

The voice decibel system will alert or notify the user if the voice decibel of the call goes below or above the predetermined threshold value by providing a vibration or audible alert during the call as each incident occurs, or by termination of the call at a single point of defined point of deviation of the voice decibel value, or by sending an electronic mail/text/chat message with a report that provides details on the frequency and time in which the established parameters of voice decibel were exceeded, and as well as the average decibel system value showing both the high and low value for analysis.

System Architecture of a Mobile Device

Figure 3:
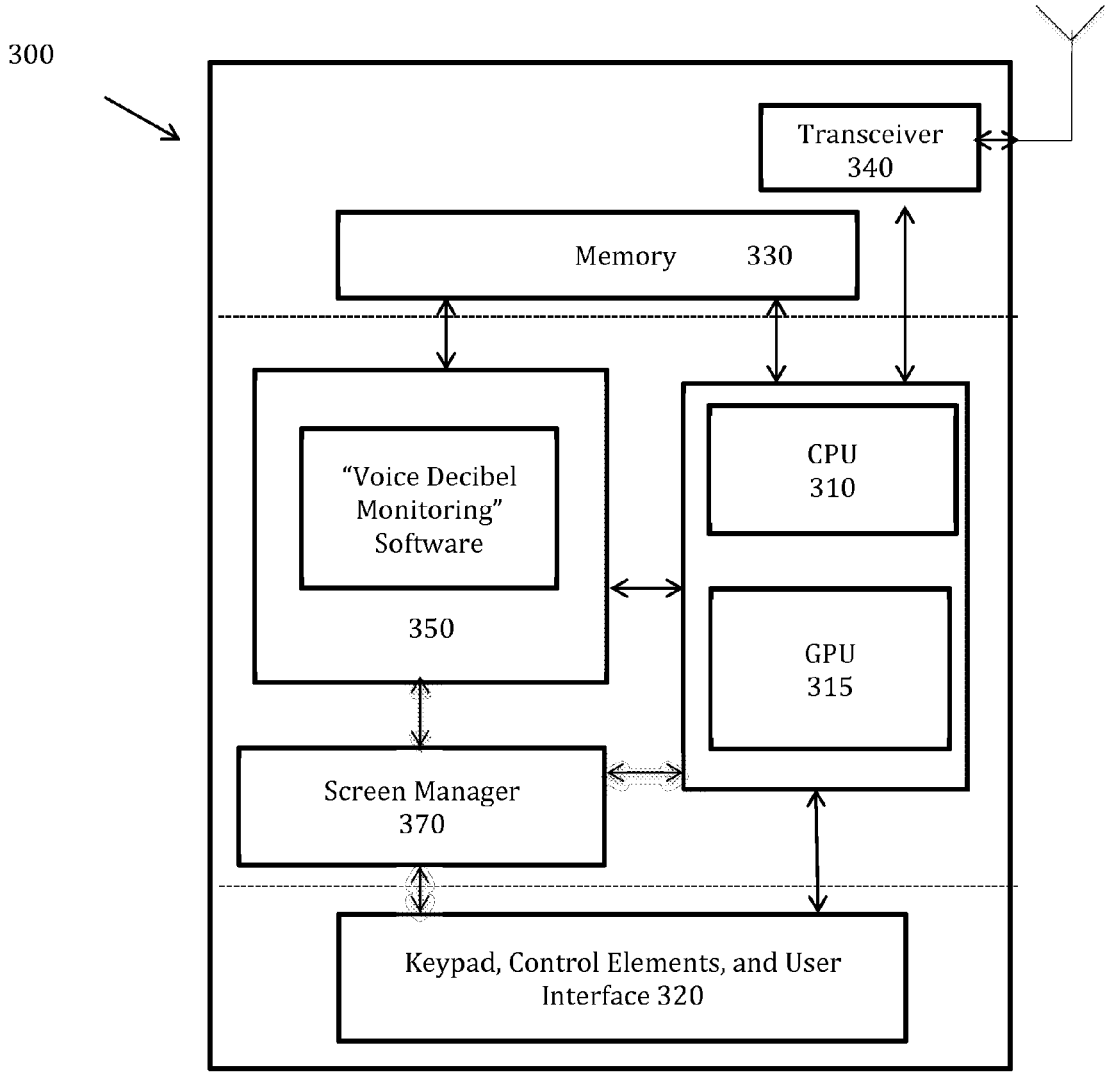
FIG. 3 is a schematic diagram of an exemplified electronic communications device with "Voice Decibel Monitoring" software installed on the device.

As illustrated in FIG. 3, the system architecture for the preferred embodiment of the present invention comprising the computer program product installed on the electronic computing device 300, comprises: an internal telephone microphone/speaker; a central processing unit (CPU) 310; a graphical processing unit (GPU) 315; a User interface with touchscreen data input keypad or keyboard or keys 320; memory 330 such as random access memory (RAM), read only memory (ROM), nonvolatile memory such as EPROM or EEROM, flash memory or hard drive memory; a transceiver 340 functionally connected to an antenna to receive and transmit data in a wireless network; and Voice Decibel Monitoring Software Application 350 of the present invention stored on an additional internal memory chip. The transceiver may operate according to standards commonly known in the art by the skilled practitioner, such as for GSM, GPRS, wireless local and personal area network standards, and Bluetooth.

GPU 315 comprises a graphics rendering module configured to perform various tasks related to calculating and displaying the screen images. Screen manager 370 with a software or firmware process that manages content displayed on the GUI 320. The screen manager monitors and controls the physical location and type and appearance of content data displayed on the GUI 320.

The electronic computing devices further comprise hardware/software for Internet connectivity to receive emails, SMS texts, chat messages, and engage in VoIP conversations. The devices comprise Enhanced Data Rate for Global Evolution (EDGE), 3G, and/or 4G data transfer capabilities.

Monitoring Signals Hardware Components

The device further comprises a signaling, sensor, and/or triggering components to transmit a physical, audio, and/or a messaging signal to the user when the user's voice decibel level is outside of the pre-set threshold. The type, frequency and duration of the signal may be adjustable by the device user.

For example, the computing device may comprise a "vibrating component" that generates a vibrating sensation from the device each time the user's voice decibel level goes above or below the pre-set thresholds. Vibrations are generated on an electronic computing device by methods well known in the art, such as using a haptics motor installed within the device.

The device may further comprise an "audio component" that generates an audible signal from the speaker of the electronic computing device each time the user's voice decibel level goes above or below the pre-set thresholds. The signal may be a short burst (e.g. beep), voice recording, a melody, etc. and as enabled by the "Voice Decibel Monitoring" software. The type, frequency, and duration of the audible signal may be adjustable by the device User or 3rd party administrator such as a therapist or employer or teacher.

The device may further comprise hardware/software to enable the user to receive an electronic message during or after the conversation. For example, the user may receive an email, text, or chat room message immediately after each incident of the user's voice decibel level going above or below the pre-set thresholds. Likewise, the user may receive an electronic message after the conversation is complete, wherein the message (e.g. an email) comprises a report detailing the user's voice decibels levels throughout the conversation and related statistics.

Computer Program Product

The computer program product comprises program instructions recorded on a non-transitory computer readable medium, wherein upon execution on a computer, said program instructions monitor a user's voice decibel level while conversing on an electronic computing, said program instructions comprising the steps of FIG. 2.

As shown in FIG. 3, the computer program product 350 is stored on the device's memory 300 and is executed by the client computer's CPU 310. It will be appreciated by one with skill in the art that the application might be installed on the client computer from a number of sources. For example, it may be: downloaded over the Internet from a server, or bundled with software provided by another software manufacturer (such as a Web browser provided by a Web browser manufacturer). In another embodiment of the present invention, the voice decibel application is hardwired from the electronic computing device manufacturer into the device. The enhancement of the software is performed by downloading the required files from the Internet. It will be appreciated that the application will function in substantially the same manner regardless of the installation source or method.

Recording and Filtering Conversation

In order to calculate and analyze the voice decibel level of one speaker in a two way conversation, the system must: record the audio content of the conversation; filter out one of the speakers (i.e. the recipient); and analyze the content of the remaining speaker for decibel levels frame-by-frame. For the system to analyze the conversation and trigger the alarms in real-time (e.g. vibrations, audio signals, call termination when user's voice goes outside the pre-set decibel max/min levels), then the computer program product must receive, filter out the recipient's voice, and analyze the remaining user's decibel level in real-time. In cases where both speakers are recorded (e.g. in person conversations) then the software filters and analyzes each speaker's voice decibel levels separately.

Therefore, the computer program product has the ability to record the audio content of a wireless or VoIP conversation, or to utilize the recordings from another source in real-time. For example, the computer program product may comprise modules that analyze a VoIP conversation conducted on a three way line between two users, wherein the third line is used for voice recording and analysis.

Methods of recording the audio content of a telephone conversation by a third source (i.e. not the computer program product of the present invention) on an electronic computing device are well known in the art. In a preferred embodiment of the present invention, the conversation is conducted via VoIP (e.g. Vonage, Skype, etc.), using any one of a variety of methods. For example, software such as Evaer, Pamela, KishKish SAM, PowerGramo, Acrobits Softphone, etc. can be downloaded to the electronic computing device and used to record VoIP calls directly to electronic computing device's hard disk with side-by-side, separate files, audio-only, local-webcam-only and remote-webcam-only mode. The audio-only file would then be filtered for removing the recipient speaker's voice; and then analyzed by the computer program product of the present invention for decibel level content.

In another embodiment, the cellular telephone conversation may be recorded on an electronic computing device (e.g. iPhone) by again using third party software installed on the devices, such as Google Voice, iPhone Recorder by Retronyms, iSpoofCard, etc.

Telephones without Mobile Application Abilities

The present invention may be used with phones that do not have the ability to install software applications, such as the current computer program product. The present invention may still be used to analyze a user's voice after the conversation is complete by recording the conversation using hardware near and/or features installed on the phones, and then playing the conversation back near a computing device that can digitally record the playback, and analyze it with the computer program product.

Most electronic computing devices (e.g. most cell phones and smartphones) have the ability to record telephone conversations under the "Options" feature of the phone. The conversation would then be played back, or uploaded to an electronic computing device with the computer program product of the present invention installed upon it.

For electronic communications devices that do not have the ability to record a conversation, then the user may use hardware comprising a LED connected to a voice recorder, wherein the LED comprises a cord with an earpiece. The user then places the earpiece in their ear, and the phone near their ear, and the recorder will record the user's voice as they speak.

Methods of filtering audio content from a digital voice recording are well known by the skilled artisan. In a preferred embodiment of the present invention, the computer program product would comprise modules/algorithms/code to filter out the recipient's voice before analyzing the decibel levels of the user's voice.

Report Generation

The computer program product further comprises modules/algorithms/code for calculating the user's voice decibel levels as a function of time and generating a report that graphs this (e.g. decibel level "Y" axis, and time on the "X" axis). The report would then be sent via email to the user after the conversation was completed. The user could use the report to learn to modify their voice for future conversations so as to stay within the boundaries of their max/min decibel threshold levels.

Figure 4:
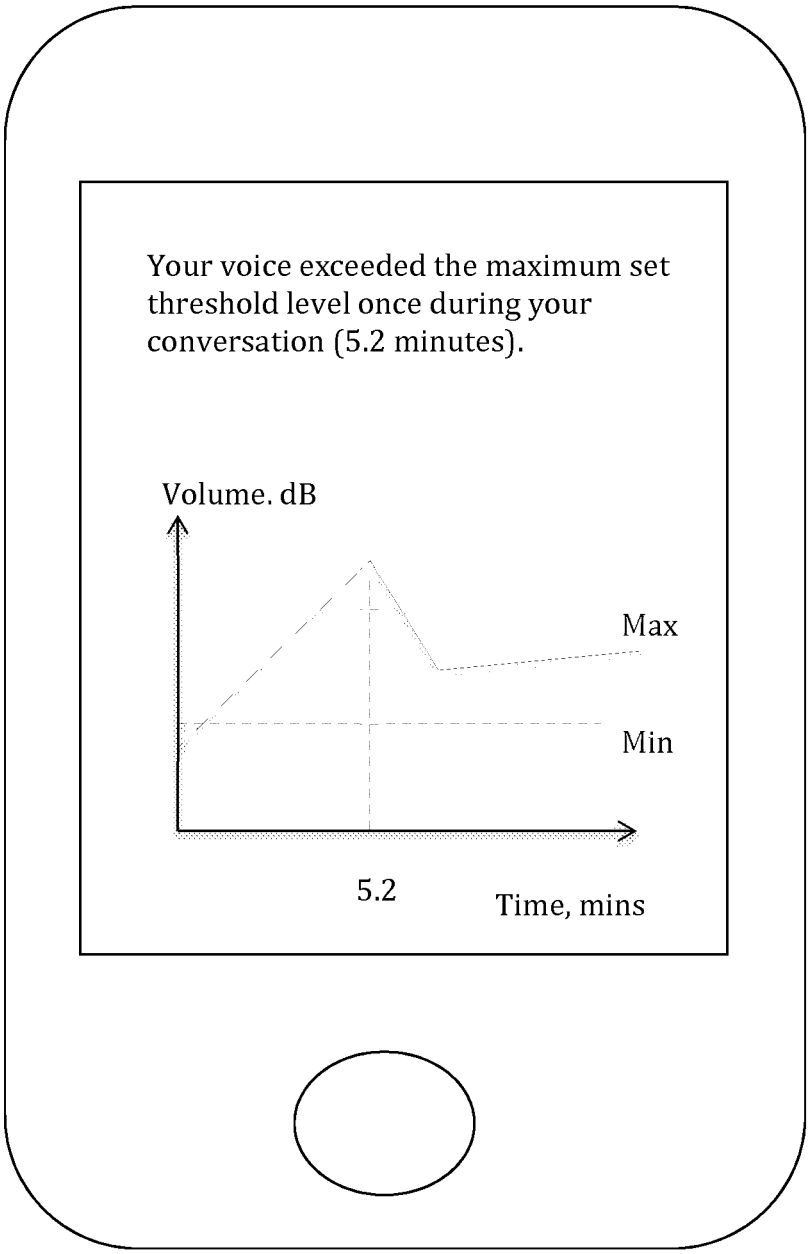
FIG. 4 is an illustration of an exemplification of a report sent to a user's email account as viewed on their electronic computing device's GUI.

FIG. 4 provides an exemplification of a report sent to a user's email account as viewed on their device's GUI. On the x-axis we have the volume in dB and on the y-axis we have the time of the conversation. The dB measurement of the speaker is recorded during the call which enables a complete graphing illustration of the full range of the dB spoken.

Although the invention has been described with reference to specific embodiments thereof, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

What is claimed is:

1. A computer implemented method for monitoring a user's voice decibel level while conversing on or near an electronic computing device, the method comprising:

(a) installing voice decibel software application on the user's electronic computing device;

(b) setting by the user of the maximum and minimum decibel threshold levels on the device using the software;

(c) calculating and storing by the computer processor the voice decibel while the user converses on the device;

(d) comparing by the computer processor the stored decibel value with the maximum/minimum threshold levels; and, (e) generating by the computer processor a signal on the device if the decibel value is outside of the maximum/minimum threshold levels.

2. The computer implemented method of claim 1 further comprising, the computer processor recording and storing the conversation, and filtering out the recipient's voice before said calculating of the user's voice decibel level.

3. The computer implemented method of claim 2 wherein said conversation is in person, further comprising, the computer processor filtering out and calculating the user's and recipient's voice decibel level separately.

4. The computer implemented method of claim 1, wherein said signal comprises physical and audible device emissions, text and instant messages, and/or automatic termination of the electronic communication.

5. The computer implemented method of claim 1 further comprising, the computer processor generating a report on the user's speaking pattern and behavior, and electronically transmitting said report to the user's email.

6. The computer implemented method of claim 1, wherein said conversing on an electronic computing device enabled for cellular telephone connectivity, or Internet connectivity.

7. The computer implemented method of claim 1, wherein said cellular telephone connectivity comprises three way calling lines, and said Internet connectivity comprises Voice over Internet Protocol with three way calling lines, wherein one call line is utilized for recording the conversation.

8. A computer program product comprising program instructions recorded on a non-transitory computer readable medium for monitoring a user's voice decibel level while conversing on or near an electronic computing device, wherein upon execution on a computer, said program instructions monitor a user's voice decibel level while conversing on or near an electronic computing, said program instructions comprising:

(a) code for installation of voice decibel software application on the user's electronic computing device;

(b) code for setting by the user of the maximum and minimum decibel threshold levels on the device using the software;

(c) code for the software calculating and storing the voice decibel while the user converses on the device;

(d) code for the software comparing the stored decibel value with the max/min threshold levels; and, (e) code for the software generating a signal on the device if the decibel value is outside of the max/min threshold levels.

9. The computer program product of claim 8 further comprising, the computer processor recording and storing the conversation, and filtering out the recipient's voice before said calculating of the user's voice decibel level.

10. The computer program product of claim 9 further comprising, wherein said conversation is in person, further comprising, the computer processor filtering out and calculating the user's and recipient's voice decibel levels separately.

11. The computer program product of claim 8, wherein said signal comprises physical and audible device emissions, text and instant messages, and/or automatic termination of the electronic communication; and further comprising said processor generating a report on the user's speaking pattern and behavior, and electronically transmitting said report to the user's email.

12. The computer program product of claim 8, wherein said conversing on an electronic computing device enabled for cellular telephone connectivity, or Internet connectivity.

13. The computer program product of claim 8, wherein said cellular telephone connectivity comprises three way calling lines, and said Internet connectivity comprises Voice over Internet Protocol with three way calling lines, wherein one call line is utilized for recording the conversation.

14. A system comprising an electronic computing device in communication, wherein said device comprises: a non-transitory computer-readable storage device comprising instructions; and one or more processors coupled to the non-transitory computer-readable storage device and configured to execute the instructions to perform operations comprising:

(a) installing voice decibel software application on the user's electronic computing device;

(b) setting by the user of the maximum and minimum decibel threshold levels on the device using the software;

(c) calculating and storing by the computer processor the voice decibel while the user converses on the device;

(d) comparing by the computer processor the stored decibel value with the maximum/minimum threshold levels; and, (e) generating by the computer processor a signal on the device if the decibel value is outside of the maximum/minimum threshold levels.

15. The system of claim 14 further comprising, the computer processor recording and storing the conversation, and filtering out the recipient's voice before said calculating of the user's voice decibel level.

16. The system of claim 15 wherein said conversation is in person, further comprising, the computer processor filtering out and calculating the user's and recipient's voice decibel levels separately.

17. The system of claim 14, wherein said signal comprises physical and audible device emissions, text and instant messages, and/or automatic termination of the electronic communication.

18. The system of claim 14 further comprising, the computer processor generating a report on the user's speaking pattern and behavior, and electronically transmitting said report to the user's email.

19. The system of claim 14, wherein said conversing on an electronic computing device enabled for cellular telephone connectivity, or Internet connectivity.

20. The system of claim 14, wherein said cellular telephone connectivity comprises three way calling lines, and said Internet connectivity comprises Voice over Internet Protocol with three way calling line, wherein one call line is utilized for recording the conversation.

* * * * *